US012747868B2

(12) United States Patent
Sherrill et al.

(10) Patent No.: US 12,747,868 B2
(45) Date of Patent: Sep. 29, 2026

(54) SYSTEM AND METHOD FOR INSULATING AN OUTDOOR PATIO HEATER

(71) Applicant: Uni-Therm International, Inc., Lewisville, TX (US)

(72) Inventors: Daniel B Sherrill, Highland Village, TX (US); Daniel J Sherrill, Corinth, TX (US)

(73) Assignee: Uni-Therm International, Inc., Lewisville, TX (US)

( * ) Notice: Subject to any disclaimer, the term of this patent is extended or adjusted under 35 U.S.C. 154(b) by 377 days.

(21) Appl. No.: 18/458,028

(22) Filed: Aug. 29, 2023

(65) Prior Publication Data

US 2024/0068673 A1 Feb. 29, 2024

Related U.S. Application Data

(60) Provisional application No. 63/373,794, filed on Aug. 29, 2022.

(51) Int. Cl.

| | |
|---|---|
| ***F24C 15/36*** | (2006.01) |
| ***F24C 1/10*** | (2021.01) |
| ***F24C 3/04*** | (2021.01) |
| ***F24C 15/34*** | (2006.01) |

(52) U.S. Cl.

CPC ..... *F24C 15/36* (2013.01); *F24C 1/10* (2013.01); *F24C 3/042* (2013.01); *F24C 15/34* (2013.01)

(58) Field of Classification Search

CPC ..... F24C 15/36; F24C 3/042; F24C 15/34; F24C 1/10; F24C 1/12; A47J 37/0786

See application file for complete search history.

(56) References Cited

U.S. PATENT DOCUMENTS

| | | | | |
|---|---|---|---|---|
| 6,745,759 | B2 * | 6/2004 | Bossler | F24C 1/10 126/92 R |
| 8,674,266 | B2 * | 3/2014 | Fis-Menache | F24C 1/00 392/407 |
| 10,222,068 | B2 * | 3/2019 | Bechtold | F24C 1/12 |

(Continued)

FOREIGN PATENT DOCUMENTS

| | | | | |
|---|---|---|---|---|
| EP | 0079808 | A1 * | 5/1983 | B32B 27/12 |
| WO | WO-2009152206 | A1 * | 12/2009 | F24C 1/10 |

OTHER PUBLICATIONS

Uni-Therm International, Inc., Patio Heater Accessory | Heater Hat, Nov. 11, 2019, Archive.org, USA.

(Continued)

*Primary Examiner* — Allen R. B. Schult
*Assistant Examiner* — Amy E Carter
(74) *Attorney, Agent, or Firm* — Timothy G. Ackermann

(57) ABSTRACT

An insulated cover for the top of an outdoor patio heater includes a toolless fastening system and multiple layers of material. The upper layer is silicone-coated fiberglass cloth; the lower layer is a high-temperature fiber glass fabric, and those enclose an insulating layer of needle mat. The upper and lower layers are formed into substantially conical shapes using three radial sewing darts that are offset from the center of the layer. The fastening system has three sprung hooks spaced around the underside of the cover to hold the cover on the conical metal top of the heater. The hooks are fixed by lacing anchors to the lower and insulating layers.

29 Claims, 12 Drawing Sheets

(56) References Cited

U.S. PATENT DOCUMENTS

| | | | | |
|---|---|---|---|---|
| 2008/0210214 | A1* | 9/2008 | Wade | A47J 37/0786 126/299 R |
| 2012/0247446 | A1* | 10/2012 | Cross | A47J 37/0786 126/25 R |
| 2012/0247447 | A1* | 10/2012 | Cross | A47J 37/0786 126/25 R |

OTHER PUBLICATIONS

Uni-Therm International, Inc., Patio Heater Accessory | Heater Hat, Nov. 3, 2021, Uni-Therm International, Inc., Lewisville TX USA (reflecting images originally present).

* cited by examiner

SYSTEM AND METHOD FOR INSULATING AN OUTDOOR PATIO HEATER

REFERENCE TO RELATED APPLICATIONS

This application claims priority to U.S. Provisional Patent Appl. No. 63/373,794.

FIELD OF THE INVENTION

Outdoor patio heaters used to provide heat, via a gas fuel source, in outdoors settings, which may have a top intended to re-direct heat downward.

BACKGROUND OF THE INVENTION

Many outdoor patio heaters have a base with an elevated burner, the burner seated atop an elevated shaft, and the burner supplied with a thin aluminum top. The tops are commonly conical, or roughly so, and are intended to reflect and/or radiate heat downward, which would normally rise by convection or be radiated upward from the exposed elevated burner. In the process, the aluminum top becomes hot itself by absorbing heat via radiation and convection, and will thus radiate and convect that heat upwardly away from the intended direction via its upper surface. Thus, the top itself is a cause of wasted energy and heat loss during operation of a patio heater.

An insulated cover seated atop the top increases the heater's thermal efficiency but must also be secured and be attractive to the user.

BRIEF STATEMENT OF THE INVENTION

An embodiment of the invention including an insulated cover increases thermal efficiency of an outdoor patio heater in two ways. First, it reduces the amount of heat loss upward, while also increasing the heated radius, the heated radius being the radius of the heated surface above the heat source that redirects heat downward. This is because the insulated cover has a much lower thermal conductivity coefficient than the aluminum top. Thus, the combined top-cover conductivity is much lower, reducing undesirable upward radiation and convection and increasing downward radiation and convection. Second, the heater's fuel use is more efficient due to the decreased heat loss and increased heated radius.

The cover may be secured by a reversible and tool-less fastening system to avoid the need for creating holes for attachment in either the top or the cover. The cover may be conical or roughly conical shape to sit closely atop the heater top and have a slant height greater than that of the top. An embodiment of such tool-less connecting system incorporates a hook (including structures such as clips or other hook-shaped devices) fixed to the underside of the cover, using a connector such as a lacing pin (lacing anchor) connected to the cover and a spring between the pin and hook. A spring and hook system (sprung hook) may be placed in two, three, or more locations spaced therearound, preferably equidistantly. In another embodiment, one or more unsprung hooks are used across a less-than-180-degree section of the cover, typically adjacent to one another, with one or more sprung hooks on the remainder of the cover.

This spring and hook system is connected at a slant distance (along the slant height of the cover) from the vertex so as to hook on the rim (around the base) of the existing conical top of the patio heater. This distance is such that the spring is extended (stretched) outwardly to apply a tensioning force on the hook to retain the hook (and thus the cover) in place on that rim. Thus, the connection point of the spring and hook system, and the slant distance thereof, takes into consideration both the size (radius/slant height) of the top and the length of the connector-spring-hook assembly from the connection point. This connection point of the spring and hook system may also be expressed in terms a radial distance (along the cone's base) from projection of the vertex of the cover. Straps may also be used to connect the spring and hook system to the inside of the cover.

The cover is low-conductivity and formed of materials to insulate the cover, reducing convention and radiation therefrom. The cover may be created from layers of materials, such as a cool layer that is exterior, a hot layer that is interior, and an insulating later therebetween. The cover may be formed of two or three or more sector-shaped sections of a total of less than about 360 degrees arc, to facilitate manufacturing, and then sewn together to form a generally conical shape. The cool and hot layers may also be formed from a circular blank with two or three or more sewing darts formed therein to effectively remove wedge-shaped pieces from the layer to form a generally conical shape. The darts need not (or need not all) extend fully to the center of the circular blank, but may be offset therefrom by a gap. The insulating layer may be formed from a circular blank by physically removing one or more wedge-shaped pieces from the layer to form a generally conical shape. Multiple wedge-shaped pieces may not (or may not all) extend fully to the center of the circular blank, as doing so would separate the circular blank into sections.

Sewing darts are a way of causing a fabric material to take on a 3-dimensional shape, which includes a cone or roughly conical shape. A sewing dart can be made by joining fabric along two join lines. The join lines may be laterally-separated. The amount of lateral separation forms the amount intake, that is the amount of material (which can be measured laterally to those join lines) that is effectively removed from the fabric (or blank). The join lines may be angularly-separated, which can be used to form a cone or roughly conical shape. The amount of angular separation as measured from the point (where the two join lines meet) is the subtracted angle. The subtracted angle reflects the amount of intake, that is the amount of material between those join lines) that is effectively removed from the fabric (or blank). Because there is angular separation, that amount of material increases as one moves away from the point. Between the two join lines the intake forms a flap down the center of which runs a central fold line, reflecting the midline of the join lines and of the flap if it is pressed flat (thus creating a fold). If the intake is pressed down to the material, one of the join lines becomes the folded join line (towards which the intake is folded down) and the other becomes the target join line (away from which the intake is folded down). The dart length extends along the join lines and the central fold line, and reflects the length of the sewn dart. The dart is joined (typically sewn) together to hold the join lines together. One or more sewn lines may be used. The sewn lines are through the intake and the material outward (from the central fold line) of the join lines, thus passing through three layers of the material.

The cool and hot layers may be hemmed together along a sewline around their outer (circumferential) edges, to create a clean edge and that also encloses the insulating layer therebetween. The insulating layer may be fixed to one or both of the cool and hot layers to prevent movement within the two outer layers, and may be fixed to the hot layer at multiple points by a connector.

The cool (upper) layer material may be a high-temperature and weather-resistant material, including a silicone-coated fiberglass cloth or another silicone material suitable to keep rain from soaking into the insulating material. The cool layer may be larger in diameter than the insulating and hot layers to cover those layers and as it forms the outside of the conical shape.

The insulating (middle) layer material may be especially low-conductivity, for instance a layer of needle mat, formed of glass fiber (e.g. 100% grade E fibers), that is a non-woven glass fiber mat. The insulating layer may be about ½ inch to 1 inch in thickness. The insulating layer may be smaller in diameter than the insulating and hot layers to fit within those layers inside the conical shape.

The hot (underside) layer material of the cover must be able to be safely exposed to the high temperature of the upper surface of the cover. The hot layer material also retains the spring and hook system at the connecting point (with the insulating layer) via the lacing anchor pin. The hot layer may be smaller in diameter than the cool layer as it forms the inside of the conical shape. The hot layer material also retains the spring and hook system at the connecting point (with the insulating layer) via the lacing anchor washer & pin. The lacing anchor washer can be placed through a dart of the hot layer material to reinforce that connection.

The hot layer material may be a high-temperature fiber glass fabric, such as a woven heat-treated fiber glass fabric, and particularly a filament-woven heat-treated fiber glass fabric made from highly-texturized fiber glass yarn, sometime known as filament yarn, having service temperatures of around 1000° F./538° C. and having a thermal conductivity of about 0.047 W/mK and a thermal transmittance of about 22.28 $W/m^2K$. Such a filament yarn can be formed by extruding molten fiber glass through a bushing to a specific size and, optionally applying a coating that is then dried and wound for shipment. That filament yarn may also be made into textured filament yarn, by having the filaments to the blown apart by air, a process that produces bulk and texture in the textured filament yarn. In this process, many fibers are broken, which may be subsequently released during use.

Heat treating the fiber glass fabric can avoid smoking or discoloration that may occur upon a hot layer material being first heated by the cover/heater. An aluminized reflector material may also be used. The exposed lower part (or all of) that hot layer material may be manufactured or dyed to a specific color corresponding to the expected color that that material would take on after long-term use (e.g. a darker, burned, or brownish coloration), so as to reduce user concern that the material is damaged due to exposure to heat.

The connector described above may be connected to, or extend through, two or three of the layers in such a fashion as to connect all three layers to limit or prevent relative movement thereof, and in such a fashion as not to pierce the cool layer to avoid water penetration.

DETAILED DESCRIPTION OF THE INVENTION

Figure 1B:
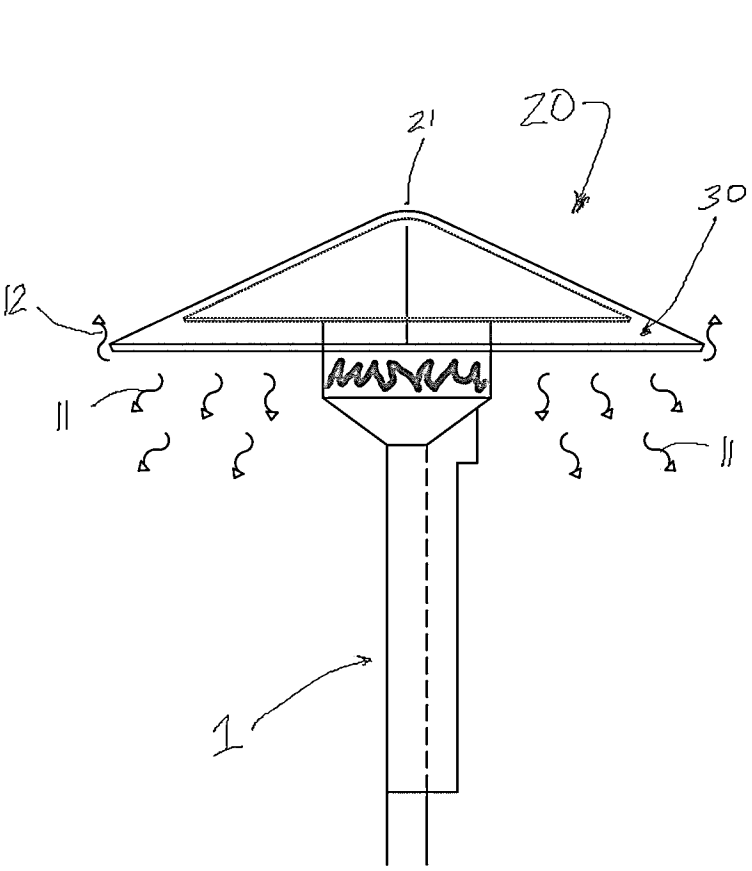
FIG. 1B is a front view of an embodiment of the invention on a patio heater.

Referring to FIGS. 1A-1B, 2A-2C, and 3A-3C, an embodiment of the invention includes insulated cover 20, which is roughly conical in shape, and includes vertex 21 at its top, slant height 22 measured radially along its surface from vertex 21 to its outer edge, and includes darts 80 on cool layer 32 and darts 100 on hot layer 40 extending radially in a direction away from vertex 21 to its outer edge. Insulated cover 20 includes cover portion 30 and three fastening systems 50 mounted on the interior of cover portion 30. Slant height 22 is greater than slant height 9 of top 5, to increase the size of heated radius 14.

Turning particularly to FIGS. 2B, 3A-3D, 3F, and 3G, in an embodiment, cover portion 30 includes cool layer 32 on its upper side, hot layer 40 on its underside, and insulating layer 35 between cool layer 32 and hot layer 40, and hem 46 around the outer edges of cool layer 32 and hot layer 40. Hot layer 40 and insulating layer 35 are joined together, in an embodiment, by connectors 53. Hem 46, formed by hem sewline 47, joins together hot layer 40 and cool layer 32 around their outer edge. Cool layer 32 is formed of silicone-coated fiber glass cloth 33, insulating layer 35 is formed of needle mat 36 (made of fibers 37), and hot layer 40 is formed of fiber glass fabric 41. Exposed part 42 on the interior of hot layer 41 includes coloration 43.

In an embodiment, to fit on top 5 of patio heater 1, cover portion 30 may be about 39.5 inches in diameter at its greatest extent (to its outer edge).

Figure 3A:
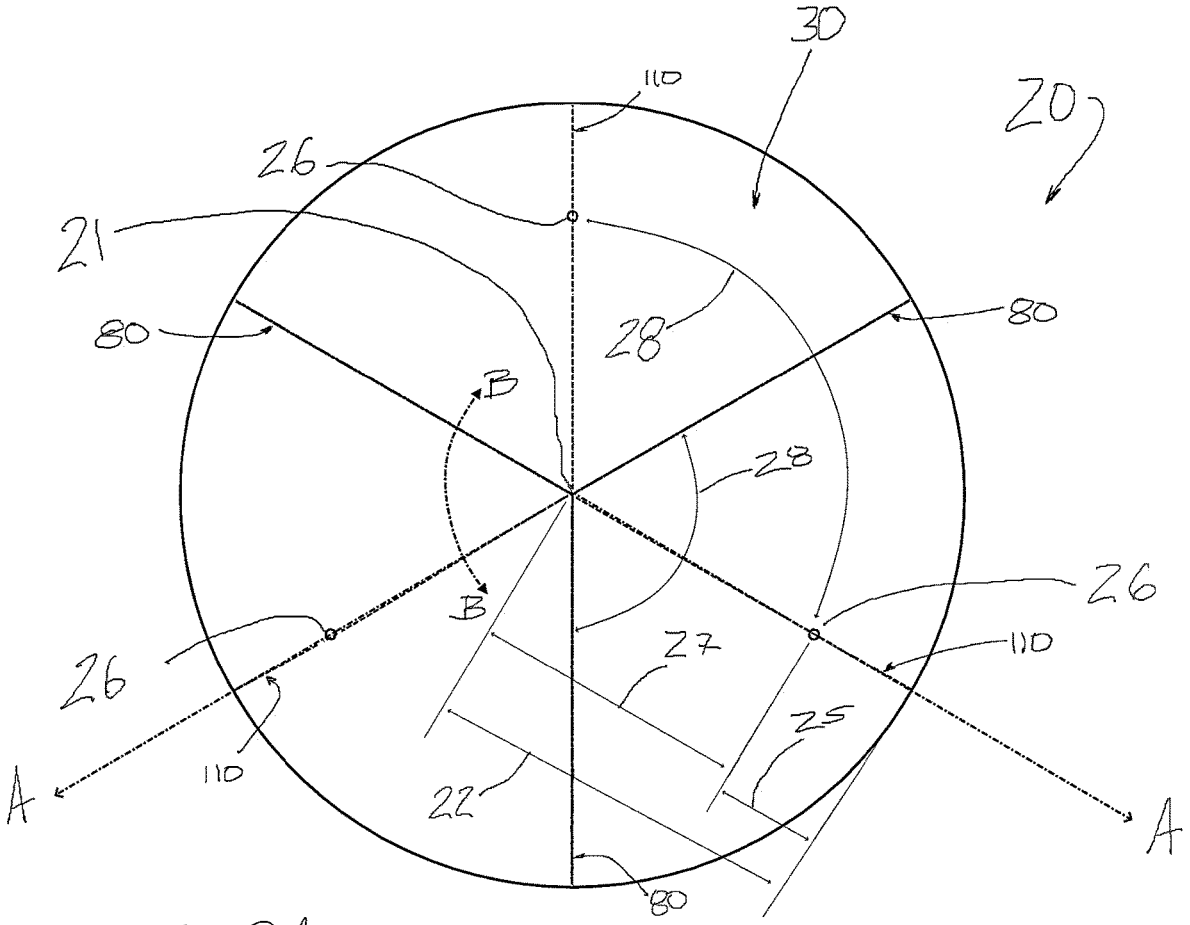
FIG. 3A is a top view of an embodiment of the invention.
Figure 3B:
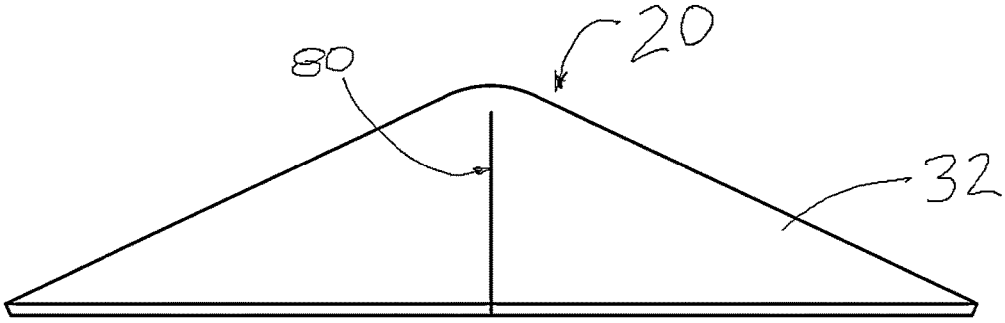
FIG. 3B is a front view of an embodiment of the invention.
Figure 3C:
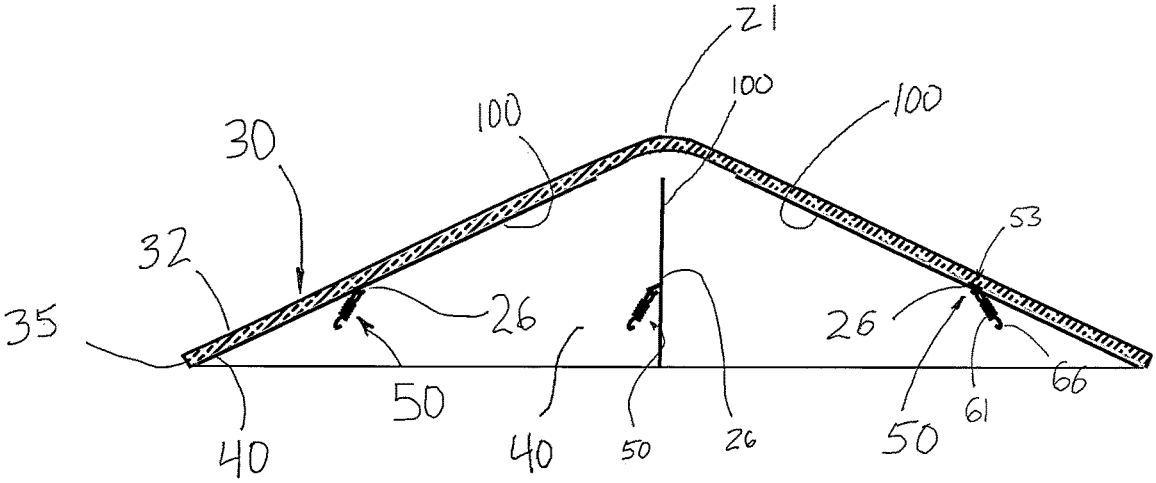
FIG. 3C is a section view along section lines A-A.
Figure 3D:
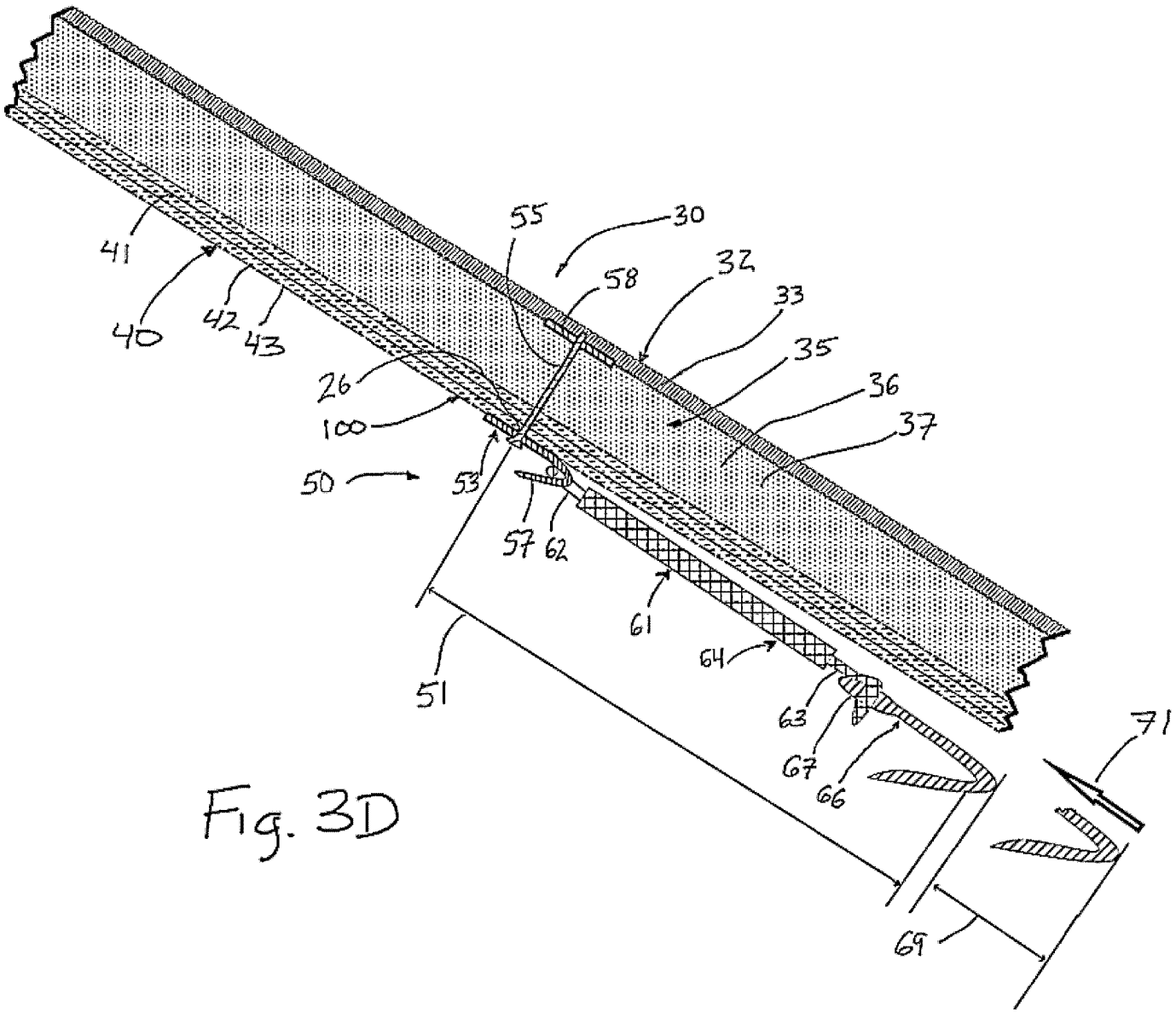
FIG. 3D is an enlarged view of one portion of FIG. 3C showing an embodiment of a fastening system.
Figure 3E:
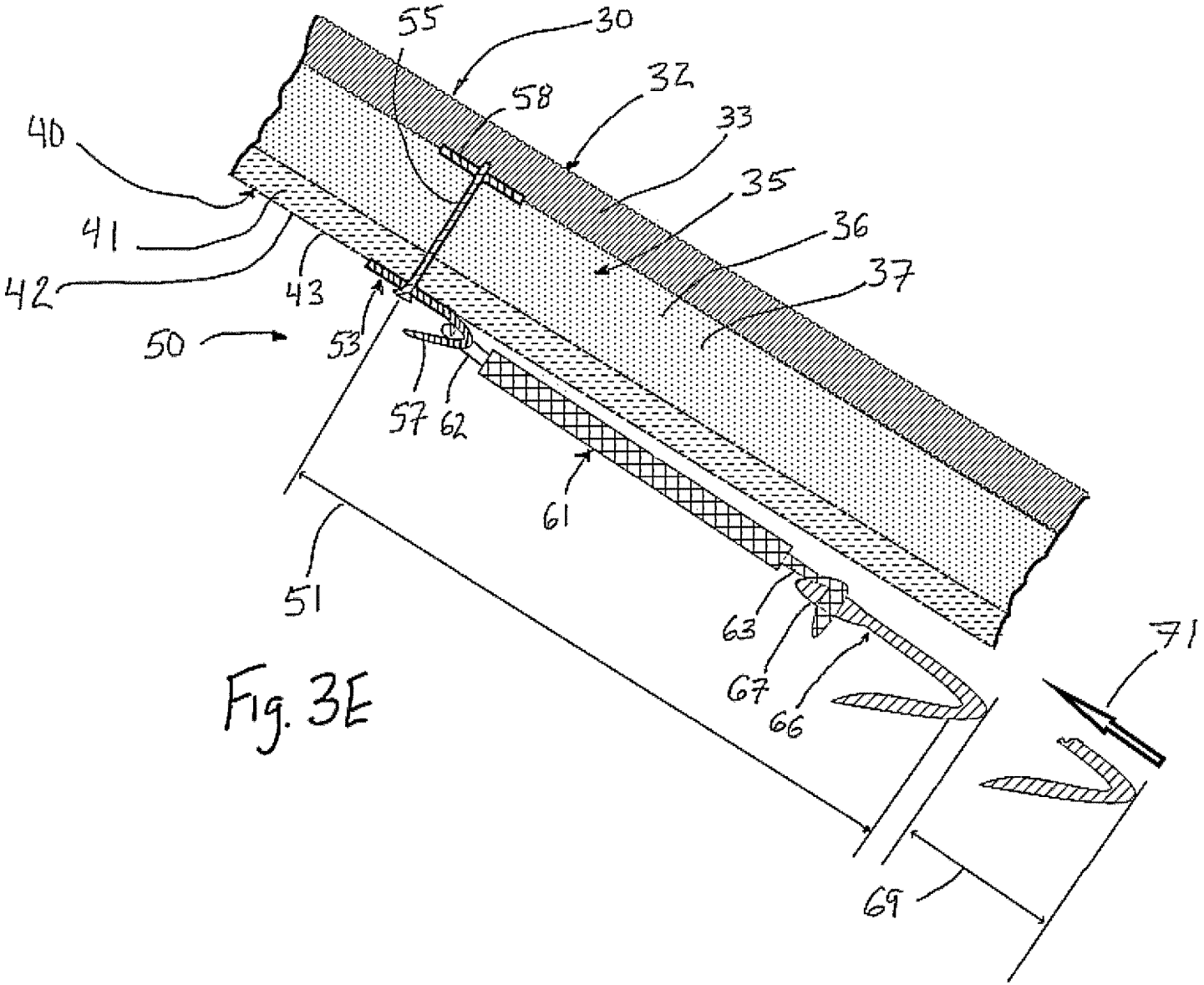
FIG. 3E shows another embodiment of FIG. 3D.
Figure 3F:
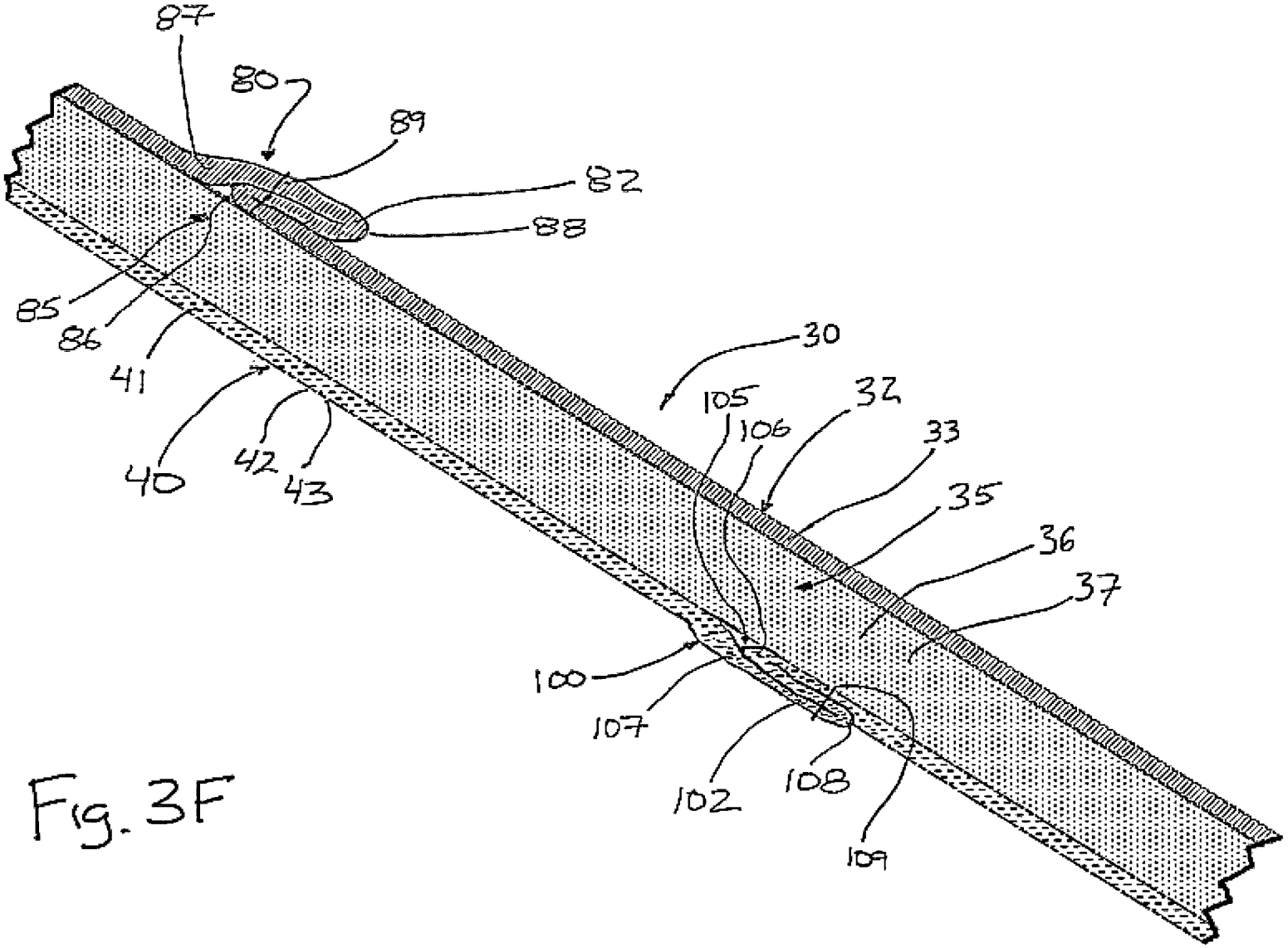
FIG. 3F is a section view along section lines B-B.
Figure 3G:
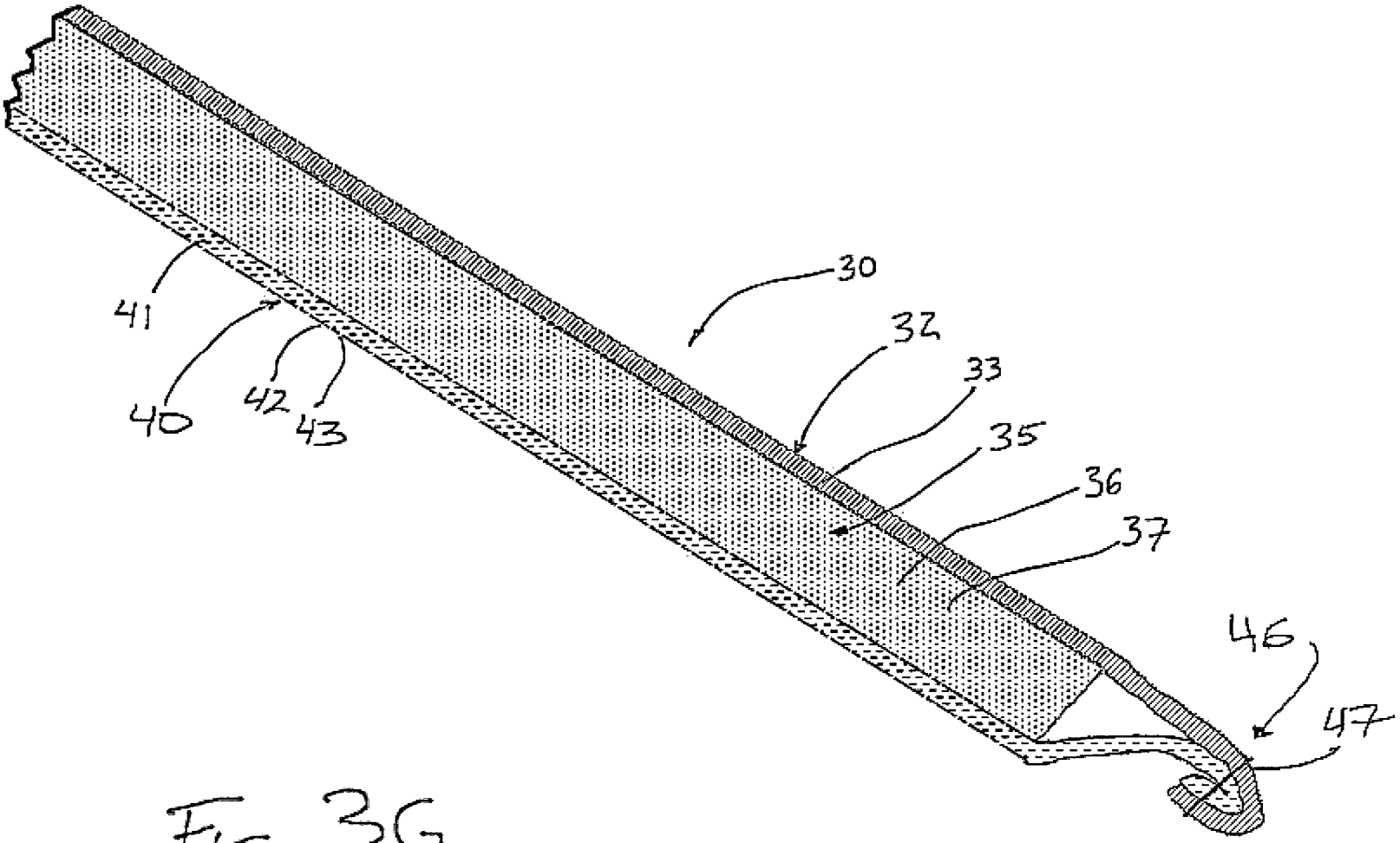
FIG. 3G is an enlarged view of an end of FIG. 3C.
Figure 4:
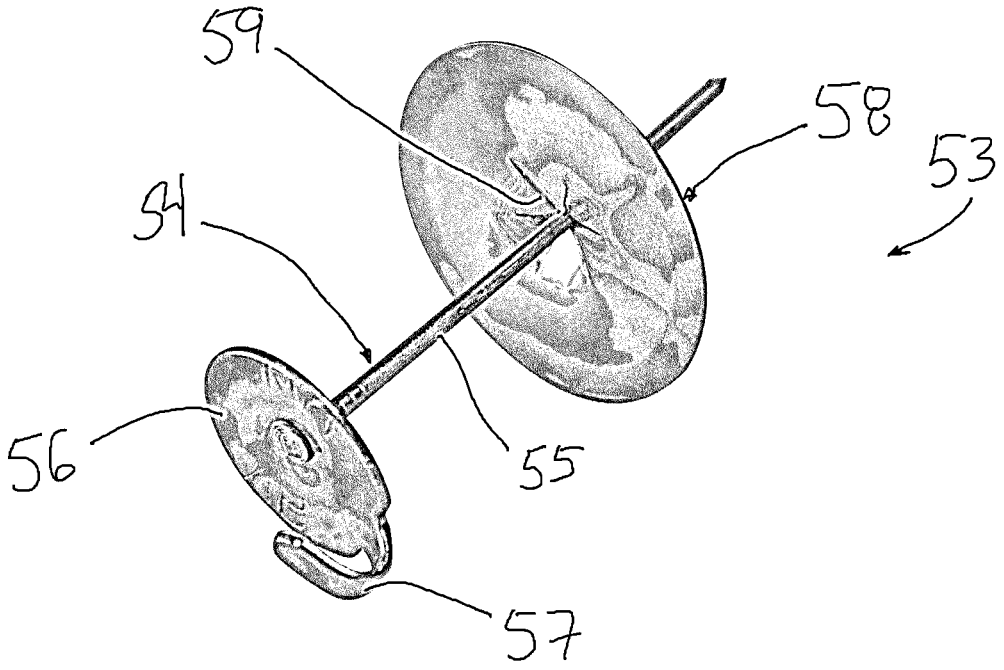
FIG. 4 is an oblique view of component of an embodiment of the invention.
Figure 5:
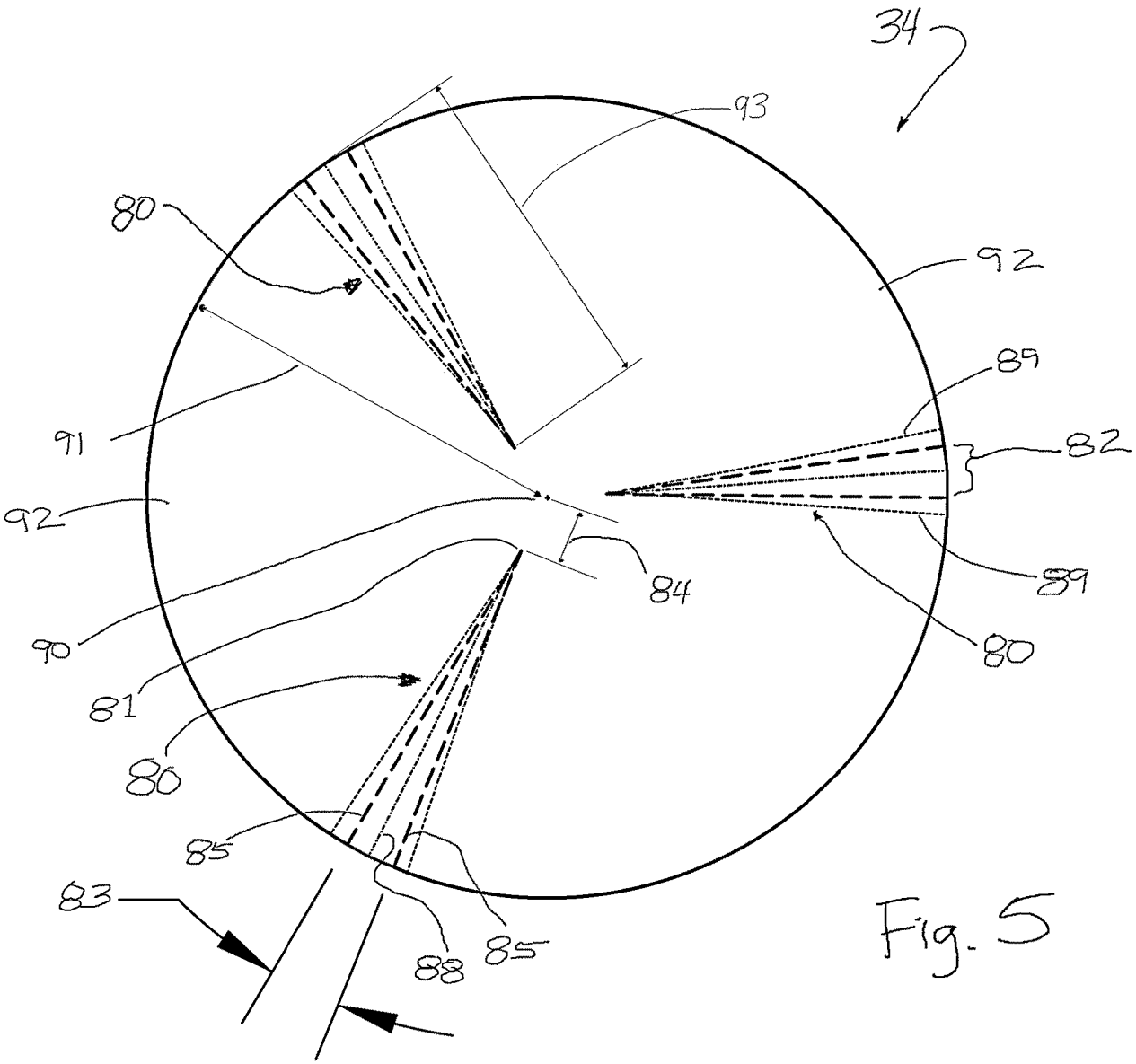
FIG. 5 is a top view of an embodiment of the invention.

Turning particularly to detail views in FIGS. 3A, 3C, 3F, and to FIG. 5, in an embodiment, darts 80 on cool layer 32 (shown in side section in FIG. 3F) extend in a radial fashion on a direction away from vertex 21. Dart 80 includes point 81, intake 82 between join lines 85 on each side of central fold line 88. Sewn line 89 is sewed through three layers of cool layer 32 material to hold join lines 85, specifically folded join line 85 and target join line 86, to one another to hold dart 80 in place along dart length 93. Darts 80 extend for dart length 93 from point 81, where point 81 is set at off-center distance 84 from centerpoint 90.

Cool layer 32 is formed into a conical or substantially conical shape from flat circular blank 34 of a silicone-coated fiberglass cloth using darts 80. Each of three darts 80 is sewn along sewn line 89 between point 81 to the outer edge (and through intake 82), thus joining folded join line 85 and target join line 86 to one another. A sewn line 89 is shown outward from each of join lines 85, but just one or both can be used. This holds dart 80 in place along dart length 93 causing blank 34 to curve inward (or to take a concave shape). With three darts 80, this causes blank 34 to form a conical or substantially conical shape for cool layer 32. Join lines 85 are angularly separated by subtracted angle 83, and meet at point 81. Point 81 can be seen to be at off-center distance 84 from centerpoint 90 of blank 34 and along a radial line with central fold line 88 at the midline between join lines 85. Hemmed area 92 is around the outer edge of blank 34. In an embodiment, blank 34 is about 42 inches in diameter before darts 80 are formed, off-center distance 104 is about 3.0, 3.5, or 4.0 inches or about 3-4 inches, dart length 93 is about 16.0, 17.0, or 18.0 inches or about 16-18 inches, taking into account hemmed area 92 of about 0.5 inches, and subtracted angle 83 is about 8, 9, or 10 degrees or about 8-10 degrees.

Figure 6:
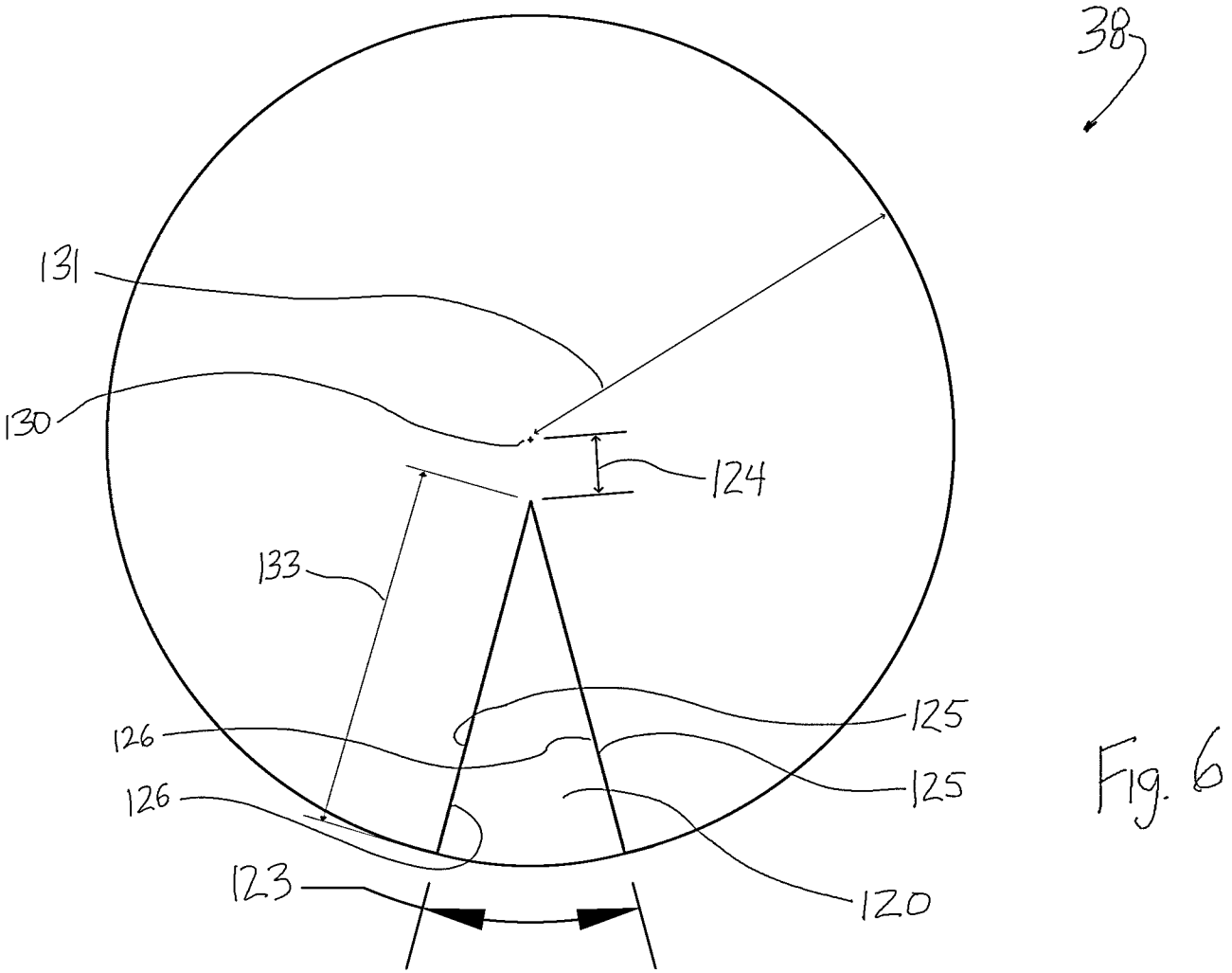
FIG. 6 is a top view of an embodiment of the invention.

Turning particularly to detail views in FIGS. 3A, 3C, 3D, 3F, 3G, and to FIG. 6, in an embodiment, removed wedge 120 in insulating layer 35 extends in a direction away from vertex 21. Removed wedge 120 is formed by cutting along cutlines 125 for wedge length 133 to form edges 126. Cutlines 125 are angularly separated by subtracted angle 123. Edges 126 are joined.

Insulating later layer 35 is formed into a conical or substantially conical shape from flat circular blank 38 of a non-woven glass fiber mat by removing removed wedge 120 from blank 38. With edges 126 sewn to one another, this causes blank 38 to curve inward (or to take a concave shape) and causes blank 38 to form a conical or substantially conical shape for insulating layer 35. Cutlines 125 are angularly separated by subtracted angle 123. The tip of the wedge can be seen to be at off-center distance 124 from centerpoint 130 of blank 38. In an embodiment, blank 38 is about 41 inches in diameter before removing removed wedge 120, and subtracted angle 123 is about 29, 30, or 31 degrees or about 29-31 degrees.

Figure 7:
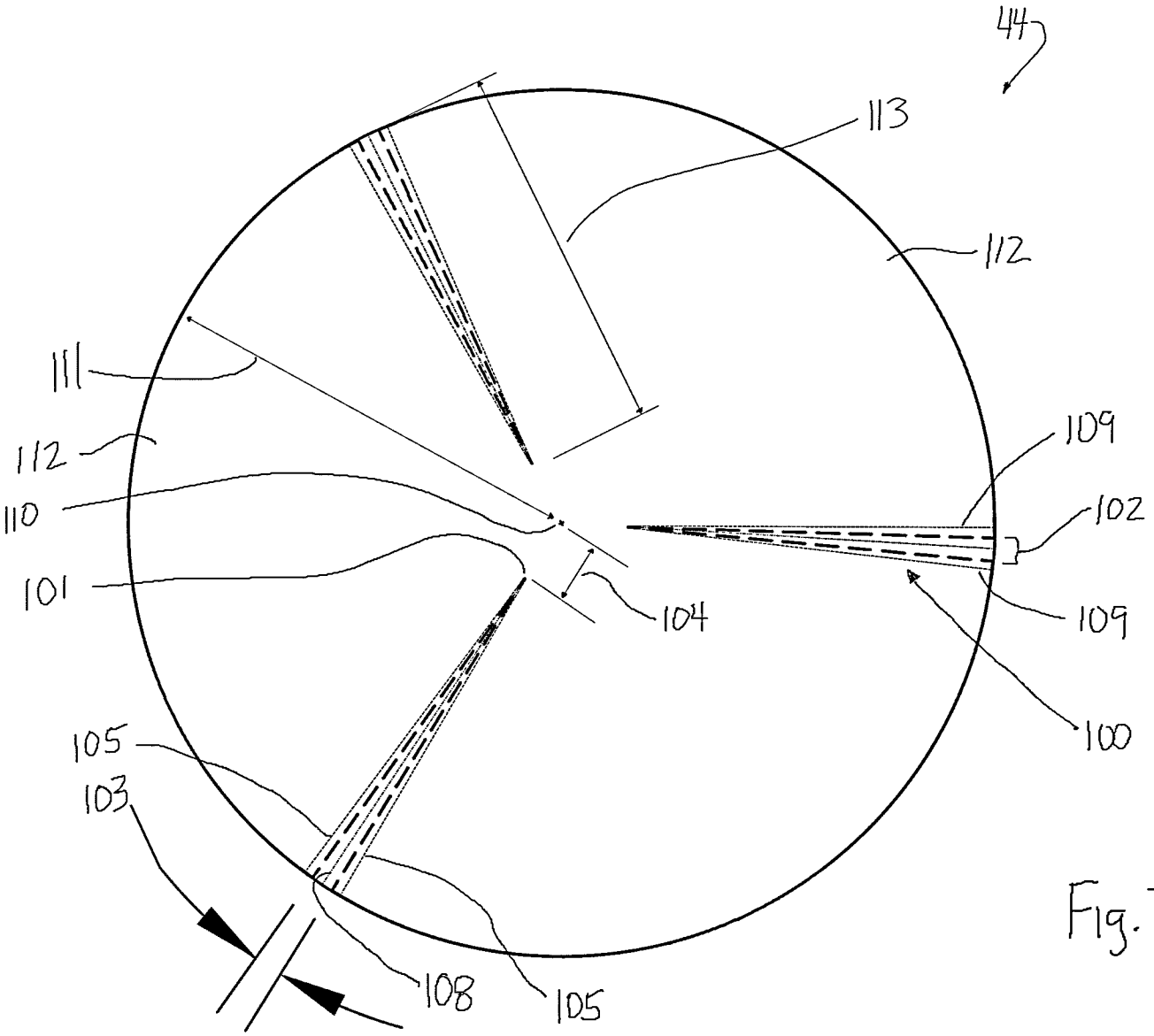
FIG. 7 is a top view of an embodiment of the invention.

Turning particularly to detail views in FIGS. 3A, 3C, 3D, 3F, and to FIG. 7, in an embodiment, darts 100 on hot layer 40 (shown longitudinal section in FIG. 3D and inside section in FIG. 3F) extend in a radial fashion on a direction away from vertex 21. Dart 100 includes point 101, intake 102 between join lines 105 on each side of central fold line 108. Sewn line 109 is sewed through three layers of hot layer 40 material to hold join lines 105, specifically folded join line 105 and target join line 106, to one another to hold dart 100 in place along dart length 113. Darts 100 extend for dart length 113 from point 101, where point 101 is set at off-center distance 104 from centerpoint 110.

Hot layer 40 is formed into a conical or substantially conical shape from flat circular blank 44 of a filament-woven heat-treated fiber glass fabric made from highly-texturized fiber glass yarn, sometimes known as filament yarn, using darts 100. Each of three darts 100 is sewn along sewn line 109 between point 101 to the outer edge (and through intake 102), thus joining folded join line 105 and target join line 106 to one another. A sewn line 109 is shown outward from each of join lines 105, but just one or both can be used. This holds dart 100 in place along dart length 113 causing blank 44 to curve inward (or to take a concave shape). With three darts 100, this causes blank 44 to form a conical or substantially conical shape for hot layer 40. Join lines 105 are angularly separated by subtracted angle 103, and meet at point 101. Point 101 can be seen to be at off-center distance 104 from centerpoint 110 of blank 44 and along a radial line with central fold line 108 at the midline between join lines 105. Hemmed area 112 is around the outer edge of blank 44. In an embodiment, blank 44 is about 40.5 inches in diameter before darts 100 are formed, off-center distance 104 is about 3.25, 3.75, or 4.25 inches or between about 3.25-4.25 inches, dart length 113 is about 15.0, 16.0, or 17.0 inches or about 15-17 inches, taking into account hemmed area 112 of about 0.5 inches, and subtracted angle is about 3, 4, or 5 degrees or about 3-5 degrees.

Turning particularly to FIGS. 3A-3D, and 4, in an embodiment, fastening systems 50 are each mounted on one of three connection points 26. Connection points 26 are located at slant distance 27 measured radially from vertex 21 along exposed part 42 of hot layer 40. Connection points 26 are set into darts 100 on hot layer 40, as shown in FIG. 3D. And connection points 26 are set apart from one another at an angular separation 28, which can be 120-degrees.

Fastening systems 50 include connector 53, spring 61, and hook 66. Fastening systems 50 have fastening system length 51, reflecting a distance between connection point 26 and hook 66 when spring 61 is unloaded.

Connector 53 includes lacing anchor 54 and washer 58. Lacing anchor includes circular flat top portion 56 with hooked portion 57 and pin 55 extending roughly normal to flat top portion 56. Washer 58 includes locking structure 59, a hole into which pin 55 may be pushed but which resists pin 55 backing out.

Spring 61 includes connector end 62 for connection to connector 53 at hooked portion 57, and hook end 63 for connection to hook 66 at hook end 63. Spring 61 can change length and, when extended from its untensioned length (reflected in fastening system length 51) by extension distance 69, apply spring tension force 71 between connector end 62 and hook end 63 and thus forms sprung hook 64.

Hook 66 includes spring end 67 for connecting to connection to spring 61. Hook 66 is hooked to connect to patio heater 1.

Turning to FIG. 3D, connector 53 attaches fastening system 50 to cover portion 30 at connection point 26. Pin 55 of lacing anchor 54 is forced through three layers of material of hot layer 40, including intake 102 of dart 100, and insulating layer 35. Washer 59 is forced over the end of pin 55, with pin 55 locked thereon via locking structure 59. Cool layer 32 overlays washer 59, so that washer 59 is located between cool layer 40 and insulating layer 35. Lacing anchor 54 is on the interior of cover portion, adjacent to exposed part 42 of hot layer 40, with hooked portion 57 oriented radially outward to the edge of cover portion 30. (FIG. 3E shows an embodiment in which connection points 26 are set off of darts 100, and pin 55 does not pass through intake 102.)

Figure 1A:
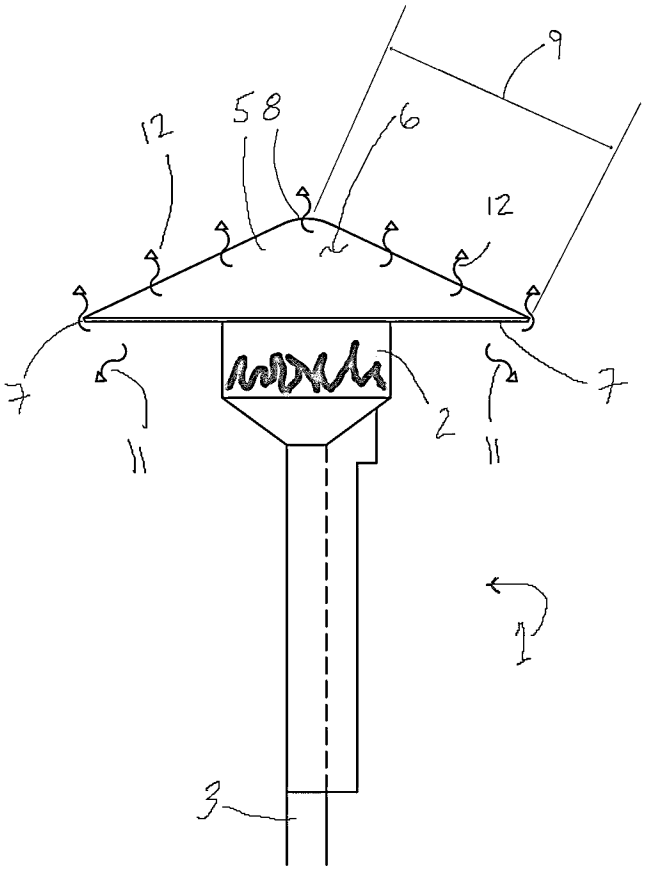
FIG. 1A is a front view of a patio heater.
Figure 2A:
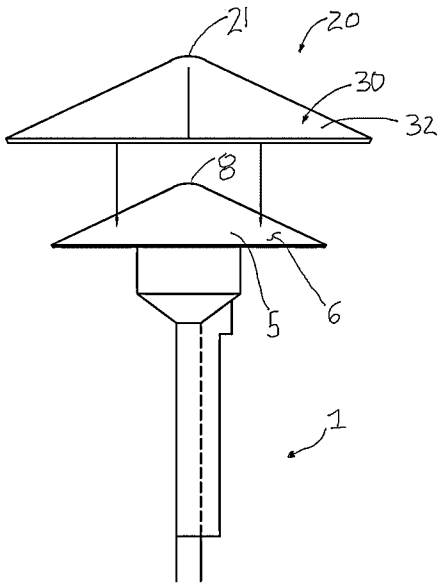
FIG. 2A is a front view of an embodiment of the invention during the mounting process on a patio heater.
Figure 2B:
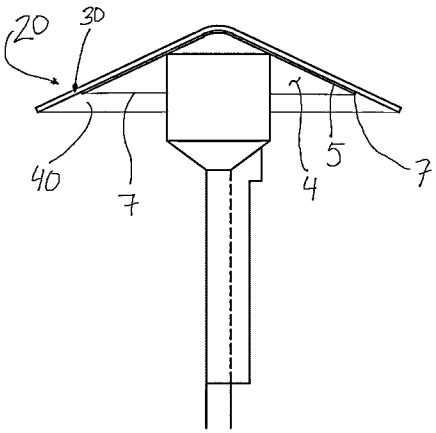
FIG. 2B is a front view of an embodiment of the invention in partial vertical section on a patio heater.
Figure 2C:
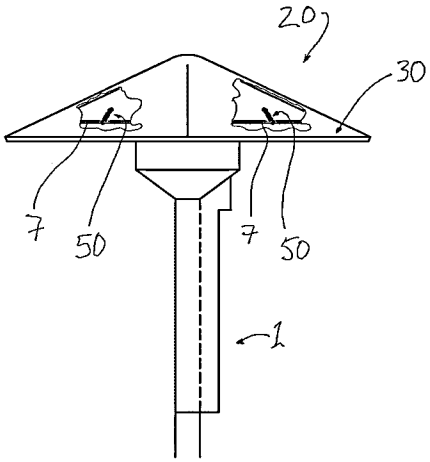
FIG. 2C is a front view of an embodiment of the invention in partial cutaway vertical section on a patio heater.

Turning particularly to FIGS. 1A-1B, in an embodiment, insulated cover 20 insulates patio heater 1 and makes it operate more efficiently and effectively. FIG. 1A shows patio heater 1 without an embodiment of the invention, showing burner 2 atop shaft 3, capped by top 5. Top 5 has lower surface 4 and upper surface 6. Top 5 has a conical shape, having vertex 8 and circumferential rim 7 and slant height 9 measured radially along its surface between vertex 8 and rim 7. FIG. 1A also shows heat 11 from burner 2 becoming escaping heat 12 from upper surface 6 of top 5. FIG. 1B shows insulated cover 20 installed on top 5 of patio heater 1, with reduced escaping heat 12 though upper surface 6, as it is insulated by insulated cover 20. Insulating top 5 causes lower surface 4 to become hotter and to radiate more heat downward.

Turning particularly to FIGS. 1A-1B, and 2A-2C, in an embodiment, insulated cover is installed on top 5 of patio heater 1. Cover portion 30 is set down upon upper surface 6 of top 5, with exposed part 42 of hot layer 40 downward to contact upper surface 6. Fastening systems 50 are then used to attach cover portion 30 to top 5. Hooks 66, extending from spring 61 and connected thereby to lacing anchor 54, are pulled outwardly to fit over rim 7 and then released to extension distance 69 to apply spring tension force 71 to retain insulating cover 20 thereon. In another embodiment, one or more adjacent hooks 66 are fitted over rim 7, and one or more hooks 66 not yet fitted are pulled outwardly to fit over rim 7 and then released to extension distance 69 to apply spring tension force 71 to retain insulating cover 20 thereon Slant height 9 of top 5 is greater than the sum of slant distance 27 and fastening system length 51, in an embodiment by extension distance 69. That is the distance between vertex 8 and rim 7 is longer than the distance between vertex 21 of insulated cover 20 and hook 66 when spring 61 is unloaded. This means when hook 66 is extended to a latched position over rim 7, spring 61 is extended by extension distance 69 and being loaded, applies a spring tension force 71 to retain hook 66 on rim 7 and cover 20 on top 5.

The invention claimed is:

1. A insulated cover for use on a patio heater top, comprising:
a cover portion having a plurality of layers;
a plurality of hooks;
the hooks connected to the cover portion;
a plurality of lacing anchors fixed to the cover portion; and
the plurality of layers of the cover portion comprising an exterior cool layer;
each of the plurality of lacing anchors fixed by in place by one of a plurality of washers; and
the plurality of washers being located inward of the cool layer.

2. A insulated cover for use on a patio heater top, comprising:
a cover portion having a plurality of layers;
a plurality of hooks;
the hooks connected to the cover portion; and
a plurality of lacing anchors fixed to the cover portion;
each of said lacing anchors connecting one of said plurality of hooks to the cover portion.

3. The cover of claim 2, further comprising
each of the lacing anchors comprising a normally-oriented pin, and a washer locked thereto;
the pin extending through at least one of the layers of the cover portion.

4. The cover of claim 3,
the cover portion comprising at least three layers;
the pin extending through at least two layers of the cover portion.

5. The cover of claim 3,
the plurality of layers comprising at least a cool layer, a hot layer, and an insulating layer therebetween; and
wherein the washers are fixed between the cool layer and the insulating layer.

6. The cover of claim 2,
the plurality of layers comprising a layer of filament-woven heat-treated fiber glass fabric, the fabric being formed by highly-texturized fiber glass yarn.

7. The cover of claim 2,
at least two of said plurality of hooks being sprung hooks.

8. A insulated cover for use on a patio heater top, comprising:
a cover portion having a plurality of layers; and
a plurality of hooks;
the hooks connected to the cover portion;
at least two of said plurality of hooks being sprung hooks.

9. The cover of claim 8,
the plurality of hooks comprising three hooks being angularly separated from one another by 120 degrees.

10. The cover of claim 8,
the plurality of layers comprising
a hot layer formed of fiber glass fabric;
a cool layer formed of silicone-coated fiber glass cloth; and
an insulating layer formed of needle mat between the hot layer and the cool layer.

11. The cover of claim 10, the hot layer formed of filament-woven glass fabric.

12. The cover of claim 11, the filament-woven glass fabric being formed of texturized fiber glass yarn.

13. A insulated cover for use on a patio heater top, comprising:
a cover portion having a plurality of layers; and
a plurality of hooks;
the hooks connected to the cover portion; and
the plurality of layers comprising at least a hot layer having an exposed coloration;
the coloration being selected from a burned or brown color.

14. A insulated cover for use on a patio heater top, comprising:
a cover portion having a plurality of layers; and
a plurality of hooks;
the hooks connected to the cover portion;
the plurality of layers comprising
a hot layer having at least one dart formed therein; and
a cool layer having at least one dart formed therein.

15. The cover of claim 14,
the hot layer having three darts formed therein; and
the cool layer having three darts formed therein.

16. The cover of claim 14,
the hot layer formed from a hot layer blank, said hot layer blank having a centerpoint;
the at least one dart comprising a point; and
the point being at an off-center distance from the centerpoint of the hot layer blank.

17. The cover of claim 14,
the hot layer formed from a hot layer blank;
the at least one dart comprising a point and two join lines that meet at the point; and
the join lines being angularly separated by a subtracted angle.

18. The cover of claim 14,
at least one of the hooks connected to the hot layer at the at least one dart formed in the hot layer.

19. A insulated cover for use on a patio heater top, comprising:
a cover portion having a plurality of layers; and
a plurality of hooks;
the hooks connected to the cover portion;
the plurality of layers comprising
a hot layer having three darts formed therein;
the darts of the hot layer having a subtracted angle; and
a cool layer having three darts formed therein;
the darts of the cool layer having a subtracted angle larger than the subtracted angle of the hot layer.

20. The cover of claim 19,
the subtracted angle of the darts of the hot layer being 3-5 degrees; and
the subtracted angle of the darts of the cool layer being 8-10 degrees.

21. The cover of claim 19,
at least two of said plurality of hooks being sprung hooks.

22. A insulated cover for use on a patio heater top, comprising:
a cover portion having a plurality of layers;
a plurality of hooks;
the hooks connected to the cover portion; and a plurality of lacing anchors;

each of the plurality of lacing anchors fixed to the cover portion by a normally-oriented pin;

the plurality of layers comprising a hot layer having a plurality of darts formed therein; and each of the pins extending through the darts formed in the hot layer.

23. A method of insulating a patio heater top, comprising:

fitting a plurality of hooks over a rim of a patio heater top;

the plurality of hooks connected to a cover portion of a patio heater cover;

the cover portion having a plurality of layers; and applying a spring tension force between at least one of said hooks and said rim.

24. The method of claim 23, the fitting step comprising fitting the hooks angularly separated from one another; and the applying step comprising applying a spring tension force between at least two said hooks and said rim.

25. The method of claim 24, at least two of said hooks being sprung hooks.

26. The method of claim 23, the patio heater cover further comprising a plurality of lacing anchors fixed to the cover portion;

each of said lacing anchors connecting one of the plurality of hooks to the cover portion.

27. The method of claim 26, the cover portion comprising at least three layers;

each of the lacing anchors comprising a normally-oriented pin; and the pin extending through only two layers of the cover portion.

28. The method of claim 23, the cover portion comprising at least three layers;

a hot layer formed of filament-woven glass fabric; and a cool layer formed of silicone-coated fiber glass cloth.

29. The method of claim 23, the cover portion comprising at least three layers;

a hot layer having a plurality of darts formed therein; and a cool layer having a plurality of darts formed therein.

* * * * *